US010697745B2

(12) United States Patent
Cooper

(10) Patent No.: US 10,697,745 B2
(45) Date of Patent: Jun. 30, 2020

(54) AMMUNITION DEVICE

(71) Applicant: David Kenneth Cooper, Nottingham (GB)

(72) Inventor: David Kenneth Cooper, Nottingham (GB)

(73) Assignee: IFTF Holding Ltd, Hucknall, Nottinghamshire (GB)

( * ) Notice: Subject to any disclaimer, the term of this patent is extended or adjusted under 35 U.S.C. 154(b) by 0 days.

(21) Appl. No.: 16/070,254

(22) PCT Filed: Feb. 3, 2017

(86) PCT No.: PCT/EP2017/052460

§ 371 (c)(1),
(2) Date: Jul. 13, 2018

(87) PCT Pub. No.: WO2017/134271

PCT Pub. Date: Aug. 10, 2017

(65) Prior Publication Data

US 2019/0025032 A1 Jan. 24, 2019

(30) Foreign Application Priority Data

Feb. 4, 2016 (GB) ..... 1601980.4

(51) Int. Cl.
*F42B 12/40* (2006.01)
*F42B 12/36* (2006.01)

(52) U.S. Cl.
CPC ..... *F42B 12/40* (2013.01); *F42B 12/367* (2013.01)

(58) Field of Classification Search
CPC ..... F42B 12/40; F42B 5/145; F42B 12/02; F42B 12/36; F42B 12/367; F42B 8/14; F42B 8/16
See application file for complete search history.

(56) References Cited

U.S. PATENT DOCUMENTS

| | | | | |
|---|---|---|---|---|
| 5,009,165 | A | 4/1991 | Morris | |
| 5,254,379 | A * | 10/1993 | Kotsiopoulos | B29C 65/08 102/501 |
| 5,259,319 | A | 11/1993 | Dravecky et al. | |
| 2007/0151474 | A1* | 7/2007 | Widener | F42B 10/24 102/501 |
| 2012/0199034 | A1 | 8/2012 | Gibson | |
| 2012/0210903 | A1 | 8/2012 | Wilson | |

FOREIGN PATENT DOCUMENTS

EP 1 157 251 B1 5/2013

OTHER PUBLICATIONS

UK Search Report in GB1601980.4, dated May 25, 2016.

* cited by examiner

*Primary Examiner* — J. Woodrow Eldred
(74) *Attorney, Agent, or Firm* — William H. Bollman

(57) ABSTRACT

The present invention discloses an ammunition device or pellet suitable for use with gas fired guns, such as paint-balling guns. The pellets have a body and a charge that are arranged as a single unit of formed as separate parts which are assembled for use. The body can be single use or reusable. The charge contains marking material and is a single-use portion arranged to be adjacent to the body. The charge has breakable outer shell for surrounding marking material.

19 Claims, 12 Drawing Sheets

AMMUNITION DEVICE

FIELD OF THE INVENTION

The present invention relates to an ammunition device, in particular to a device for use in simulation warfare and war games.

BACKGROUND

Increasing numbers of people enjoy physical activity and 'extreme sports'. In particular many people enjoy the thrill of military style sports such as air soft or paintballing. Many users find the thrill and edge of competition exciting.

Airsoft and paintballing do not provide some users with the level of realism they seek. For example in traditional paintball the characteristics of paint do not allow the ball to be completely filled, which means that more often than not, paintball projectiles have an air bubble sealed in during their manufacture, allowing contents to move around which gives a projectile carrying the ammunition an uneven flight path.

This is undesirable as the unevenness affects the flight characteristics of the projectile.

In addition a user is advised to turn packed paintball projectiles every few days in order to prevent the paint from settling.

PRIOR ART

U.S. Pat. No. 7,934,454 (CAMPO et al) discloses a core formed from a carrier and a colorant. The carrier and colorant are mixed into a core mixture, which is formed into a predetermined core shape. The core mixture is cured until substantially firm, such as by drying, heating or freezing. An outer layer may be formed adjacent the surface of the core by heating.

United States patent application US 2008/134 927 (SKELLERN) discloses a projectile with a frangible shell having both an exterior surface and an inner cavity.

The exterior surface is made up of a plurality of polygonal panels. The inner cavity contains a dispersible substance.

U.S. Pat. No. 6,145,441 (GARCIA et al) disclose a frangible payload-dispensing projectile which has a spherical capsule filled with a dispersible fill material. The exterior surface of the capsule has a plurality of spaced-apart dimples formed therein.

U.S. Pat. No. 5,009,165 (MORRIS) discloses a jacketed paint pellet comprising a jacket having a paint pellet attached thereto.

U.S. Pat. No. 5,259,319 (DRAVECKY et al) discloses a reusable training or practice round having a reusable hollow casing.

United States patent application US2012 0210903 (WILSON) discloses a reloadable training munition having a reusable shell base.

The present invention arose in order to overcome disadvantages associated with prior art devices and their methods of construction.

SUMMARY OF THE INVENTION

According to a first aspect of the present invention there is provided an ammunition device comprising: a body and a charge that breaks upon impact; the body is adapted to receive the charge; the charge is a single-use portion arranged in use to be attachable to the body wherein the charge comprises a breakable outer shell for surrounding marking material.

Typically the ammunition devices or pellets are for use with gas powered guns or electrically powered guns/firearms such as paintballing guns.

The marking material is preferably paint or powder but other chemicals or dyes may be used and these may be reflective to only a portion of the electro-magnetic spectrum, such as a particular waveband of light, for example infra-red (IR) light or ultra violet (UV) light. Alternatively the chemicals or dyes might fluoresce.

Ideally the charge is a paint that disperses on impact. The paint charge may be liquid or a powder.

Preferably the ammunition device or pellet disperses environmentally friendly powder or liquid paint when a target is hit; the liquid or powder paint exploding to produce a realistic effect.

Typically powder paint is more difficult to remove and provides higher visibility than paint which guards against cheating and dishonest play.

According to a second aspect of the invention there is provided an ammunition device comprising: a body which is reusable so that it can be used repeatedly with addition of a new charge connected to the body after a previous charge has been used or spent.

It is appreciated that the following means for connecting the charge to the body may apply to both reusable and non-reusable bodies.

In some embodiments the ammunition device includes a base portion for receiving the charge. In this way the charge is seated on a substantially rigid base portion to enable easy connection of the charge to the body and to assist with preventing puncture of the charge during assembly.

Advantageously the base portion enables charges to be more readily fitted to the body with minimal risk of marking material being released.

The charge and the body may have mutually complimentary attachment means to enable joining of the parts.

Preferably the charge and the body are adapted for attachment one to another by a push-fit connection means.

Ideally the connection means includes the base portion which is adapted to connect to a corresponding fitment on the body. In this way the charge can be readily attached to the body with no requirement for additional parts or the need for using fitting tools.

In some embodiments the base portion has a projection that is received by a corresponding opening provided on the body in order to connect the base portion and thereby the charge to the body. This provides a male and female connecting means.

In an alternative embodiment the base portion may include a recess for receiving a projection extending from the body.

In another embodiment the charge is shaped to connect with a corresponding portion of the body. This feature negates the requirement for the base portion to be part of the connection means. For example the shell surrounding the marking material may be moulded into a shape that enables connection to the body. Typically the shell is of sufficient strength so as not to break during assemble, but to break on impact when fired.

In another embodiment the connection means may include a surrounding fitment adapted to receive the charge and/or the body. For example the surrounding fitment may be a lip provided on the body that is adapted to receive the charge. The charge may include recess for accepting the lip.

In this way the outer face of the pellet has a substantially flush finish, providing smooth edges at the point of connection to aid with accurate flight when fired.

Advantageously as the charge and body are separate parts that are adapted to be connected together, the charge may be fitted onto the body and be wholly displaceable from the body. This enables new or different charges to be placed on the body, after each use or depending upon required use of the device. Furthermore the body and the charge may be kept and transported separately and connected together prior to use.

Ideally the charge and body are mechanically connected, for example by way of a male and female connection means that permits separation of the charge from the body upon impact. Advantageously in this way the charge detaches from the body upon impact so as to create a ricochet effect.

In a preferred embodiment the ammunition device or pellet may have a reusable body and a charge that breaks upon impact. The body comprises a form arranged for reuse that is capable of receiving the charge.

In this way environmental impact may be minimised, and resources maximised as the body can be reused meaning that only replacement charges are required. Typically the body is formed from strong and durable materials to enable repeated use.

For example the body may be formed from a cellular foam such as polystyrene or a synthetic rubber that is suitable for repeated use.

The body may be brightly coloured so as to enable used bodies to be easily collected after usage.

In some embodiments the pellet may be wholly composed of biodegradable material, such that the body and the charge each present minimal effect on the environment. In this way the body and the charge will degrade naturally in the environment leaving no undesirable residues and removing the requirement for spent pellets, or parts of pellets to be collected manually or otherwise. For example the body may be formed from gluten, paper or a starch based material so as to ready decompose.

The marking material may be formed from a material this is a liquid or a solid that is contained within a solid outer shell. The outer shell provides a coating or skin to contain the marking material.

In some embodiments the shell may cooperate with the base portion to define an enclosure for the marking material.

Advantageously the shell can be formed about the marking material so as to not include any airspace or air bubble in liquid that can reduce accuracy of the pellet when in flight.

The outer shell may be formed for a different material to the charge such as having a polystyrene shell or may be formed from the marking material that has been treated so as to form a shell.

For example a shell may be formed and the marking material inserted into the shell or a shell may be created around the marking material.

In some embodiments the charge is formed so as to have a front part and a rear part. The front and rear parts may be separated by at least one side.

Ideally the front part is shaped for impact and is aerodynamic so that the charge is dispersed upon impact and that the ammunition device/pellet travels accurately when fired.

Typically the rear part is arranged to connect onto or into the body. For example, so that the rear part is shaped so as to fit to the body, and form a unified device.

The rear part may comprise or receive a connector so as to aid connection of the charge to the body.

Therefore in some embodiments the connector may be a separate part suitable for connection to either or both of the charge and the body.

The connector may comprise a projection, for insertion into the body. An opposed face of the connector, relative to the projection is adapted to receive the charge. For example the opposed face may be concave so as to receive a spherical charge.

In an alternative embodiment the connection may include a projection on opposed faces so as to receive the charge on a first face and the body on a second face.

Preferably the rear part is shape to receive the body. For example the rear part of the charge may be concave to receive a corresponding convex portion of the body to fit therein. Advantageously this aids with connection and creates a stable form that securely holds the charge and body together during firing.

In some embodiments the body may be provided as a columnar form, having a distal and proximal ends, wherein the proximal end receives the charge.

The charge is typically provided on the foremost region on the device in use so that when fired the charge contacts the target first. The charge is therefore arranged so that the foremost part is fitted to be forward facing when loaded and subsequently fired.

The charge may be spherical so as to be suitable for fitting in any orientation or oval shaped so as to be suitable for fitting in two orientations.

The body also has a first end that is adapted for receiving the charge. Preferably the second end is adapted to improve flight of the pellet.

In some embodiments the second end of the body, or the distal end, may be open. This may be to assist with flight of the pellet and/or to reduce weight of the pellet. For example the second end may comprise an open cylindrical end, wherein the body is wholly or substantially tubular, surrounding an open space centrally.

Advantageously this may enable the device to be fabricated with fewer materials so that it is lighter than existing pellets. In some embodiments the open space within the body may allow the body to deform or collapse upon impact. Therefore having the open space within the body may be advantageous in allowing spent devices to be less liable to breakage or damage when lying around, pre-collection. Additionally if the body collapses upon impact, the size of the remaining, expelled pellet is reduced therefore creating less impact on the environment.

In some embodiments the open space may be filled with lightweight resiliently deformable material such as foam. In some embodiments the open space may be surrounded by a reinforced wall.

In some embodiments the wall or open space may be weighted or constructed with a balance of weight that balances or compliments the charge in use. For example in some embodiments the body may comprise a thickened wall at the distal end, providing extra weighting to balance the device in flight, and to provide extra robustness to the cylindrical nature of the body distal from the charge, so either end is robust in shape when the charge is in place.

In some embodiments the pellet may include a magnetic portion to enable spent pellets to be collected using a magnet.

The first end of the body may comprise an open cylindrical end.

It is appreciated that the charge may interact with an open or closed end of the body, depending upon formation of the body.

In some embodiments the two ends may differ, such that only one end is arranged appropriate to the charge. In some embodiments the ends may be substantially or wholly identical such that the charge may be installed or fit to either or both ends in use.

In yet a further embodiment each end of the body may be adapted to receive a different charge, therefore enabling one body suitable for use with charges of different dimensions, weights, types, colours or by different connection means.

The form of the body may comprise rifling, or raised and lowered parts to its outer surface, such that the device may be envisaged to travel more accurately, through a barrel of firearm and/or the air.

In some embodiments the body may comprise a cellular structure material, for example closed cell foam material.

In some embodiments the form may comprise internal bracing, for example internal segmentation, so as to reinforce its structure, yet permit collapse under pressure.

Some embodiments of the body may be indented, in order that the distal end of the body is liable to deformation, more than the proximal end.

For example the rearmost end of the body may include an indentation toward the charge. Advantageously the body has an indentation that defines a concave, recessed region at the distal end of the body which helps to reduce drag as the body is travels down the barrel of the firearm and is propelled through the air.

According to a third aspect of the invention there is provided an ammunition device comprising: a body and a charge can be formed as a single unit wherein the charge is a single-use portion arranged adjacent to the body and the charge comprises a breakable outer shell for surrounding marking material.

The ammunition device or pellet may be formed from a single mould that contains the charge and the body. In such an embodiment the charge and the body are placed in or formed within the mould to product a single unit ammunition device.

The charge and body may be injected into the mould so as to provide the charge and body as a single unit. In some methods of manufacture the charge and the body may be inserted or injected to the mould sequentially.

In an alternative embodiment the charge and the body may be fused together during manufacture to provide a single unit.

In yet a further embodiment the charge and the body may be bonded by an adhesive, heat process or by pressure.

In another embodiment an ammunition device according to the third aspect of the invention may be created by method of manufacture including the steps of using a mould to create a skin into which the charge and body are arranged. The skin may be rigid or flexible.

The ammunition device or pellet according to the third aspect of the invention (single unit device) may be shaped such that the body includes the shaping described in any of the above mentioned embodiments. For example the mould used to create the pellets may include rifling and/or a recessed/concave distal end to improve accuracy of flight of the pellet.

The charge provided in the single unit device is a single use charge as described in any of the above mentioned embodiments.

Typically the body provided in the single unit device may include the features described in any of the above mentioned embodiments.

The single unit ammunition device may be formed from biodegradable materials so as to permit spent ammunition to biodegrade after use.

With use of any of the above mentioned embodiments of the ammunition device/pellet impact and subsequent deployment of the suitable marking material may capable of generating a powdery impact mist that is highly visible from a great distance. This means that users, game marshals and instructors need not be nearby to call a "hit", because the impact mist will be an added visual cue for spectators or judges.

The ammunition devices or pellets advantageously provide the user with associations to traditional ammunition, and the pellets can be provided with a variety of different coloured marking material, for example to represent different teams or time slots.

The ammunition devices/pellets may be made from recycled materials.

The pellets may also comprise luminescent coating, paint or parts, so simulating a tracer round effect.

The ammunition device or pellets have improved range and accuracy over competitive paintballing and airsoft products.

It is appreciated that size, weight and shape of the pellets can be adjusted to accommodate different guns or firearms, different uses, regulations, or environmental requirements.

The use of environmentally friendly marking material to produce the charge and the option of using a biodegradable body ensures minimal impact on the environment. This may permit use of the pellets in areas previously prevents from such activities.

Preferably the ammunition devices are suitable for being received by a cartridge, magazine, or clip so as to enable rapid fire of the ammunition/pellets.

The ammunition device or pellet is adapted to operate with a range of battery powered or gas powered firearms. Preferably the pellets are for use with a box magazine such as or rotary magazine to load the pellets depending on the style of firearm. Reloading is therefore quicker and easier.

According to a fourth aspect of the present invention there is provided a cartridge of ammunitions according to the ammunition devices described above, wherein the cartridge is adapted to received and hold a plurality of ammunition devices, suitable for rapid fire.

Preferably the cartridge, magazine or clip is adapted to be received by a standard paintballing gun so that the ammunition can be fired rapidly without requirement for loading of individual loading or each ammunition.

According to a fifth aspect of the present invention there is provided a simulation war game comprising the steps of: employing ammunitions/pellets as described above in an electrically powered firearm.

Preferred embodiments of the invention will now be described, with reference to the Figures, in which:

BRIEF DESCRIPTION OF FIGURES

FIGS. 11A, 11B and 110 show two isometric exploded views of the embodiment shown in FIG. 10, and a side view, respectively.

DETAILED DESCRIPTION OF FIGURES

Figure 1:
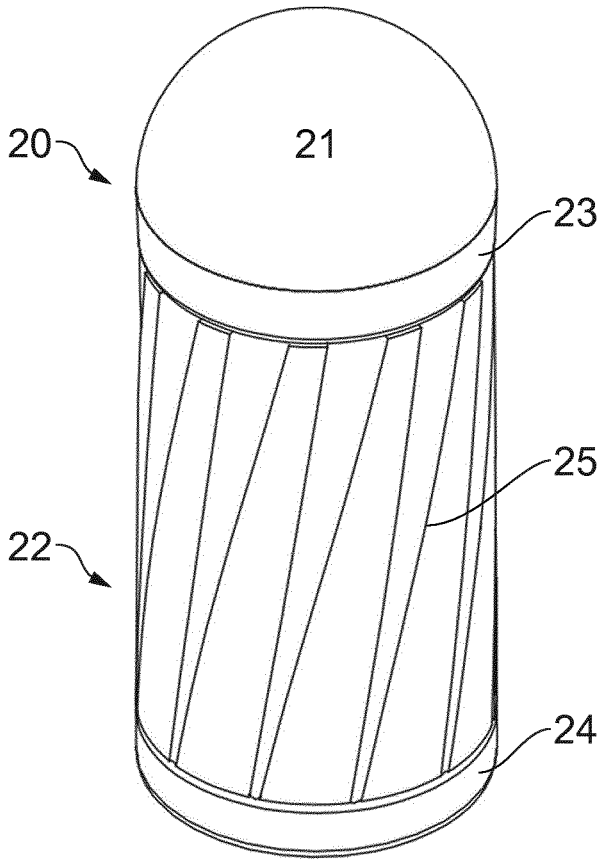
FIG. 1 shows an isometric view of a first embodiment of the ammunition device according to the present invention.
Figure 2:
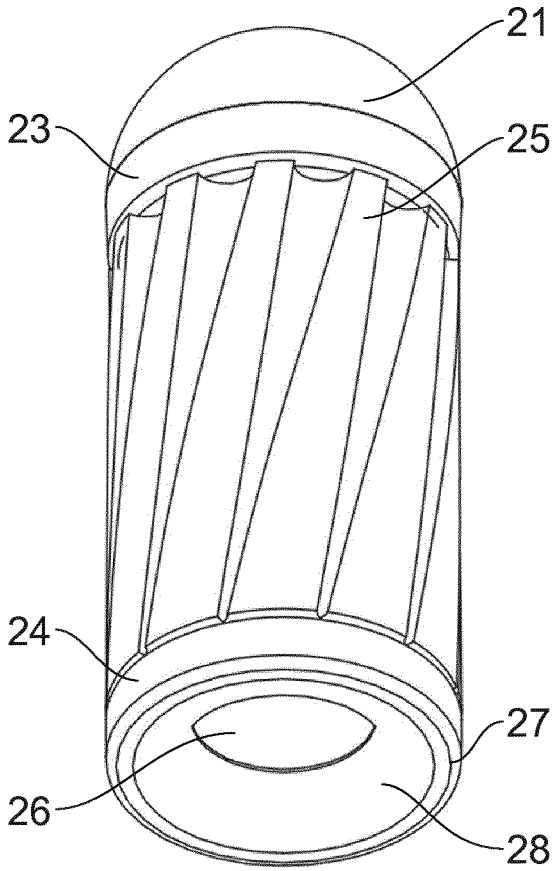
FIG. 2 shows a reverse isometric view of the embodiment shown in FIG. 1.
Figure 3:
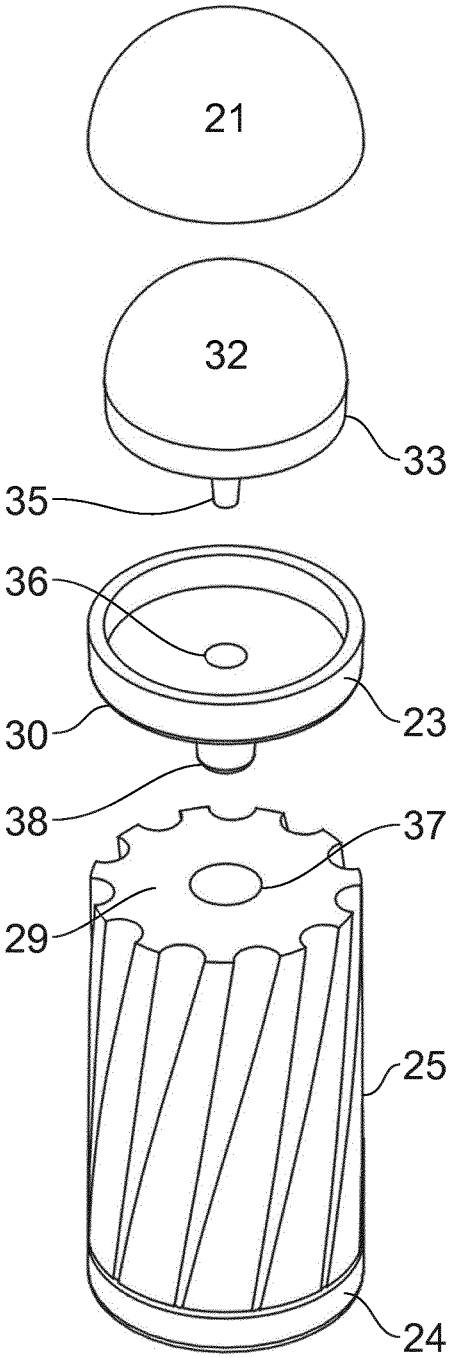
FIG. 3 shows an exploded isometric view of the embodiment shown in FIG. 1.
Figure 4:
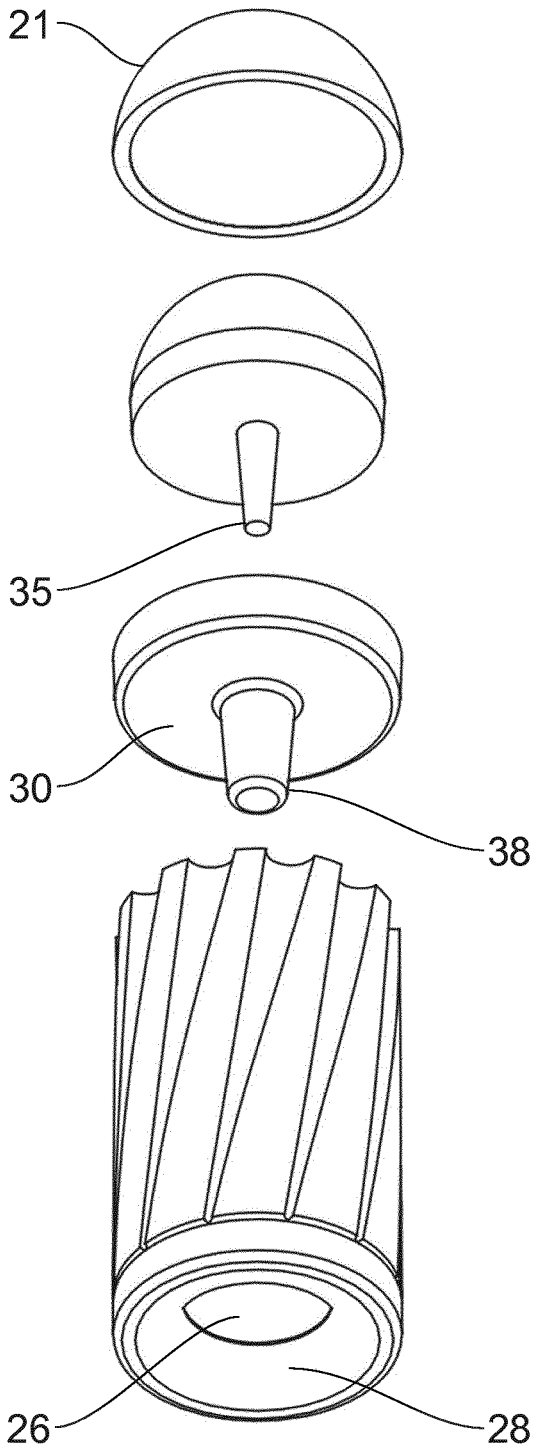
FIG. 4 shows a reverse isometric view of the embodiment of the ammunition device shown in FIG. 1.
Figure 5:
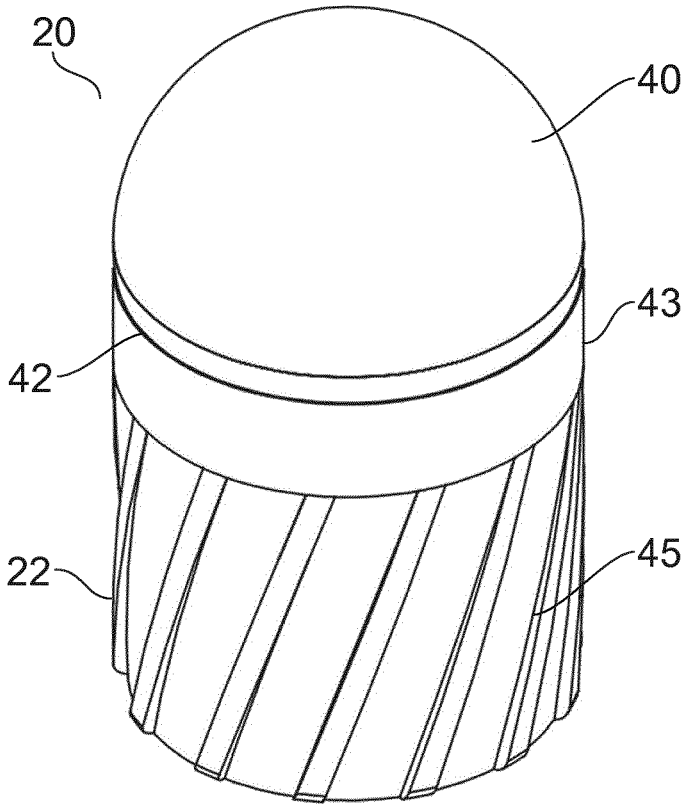
FIG. 5 shows an isometric view of a second embodiment of the ammunition device.
Figure 6:
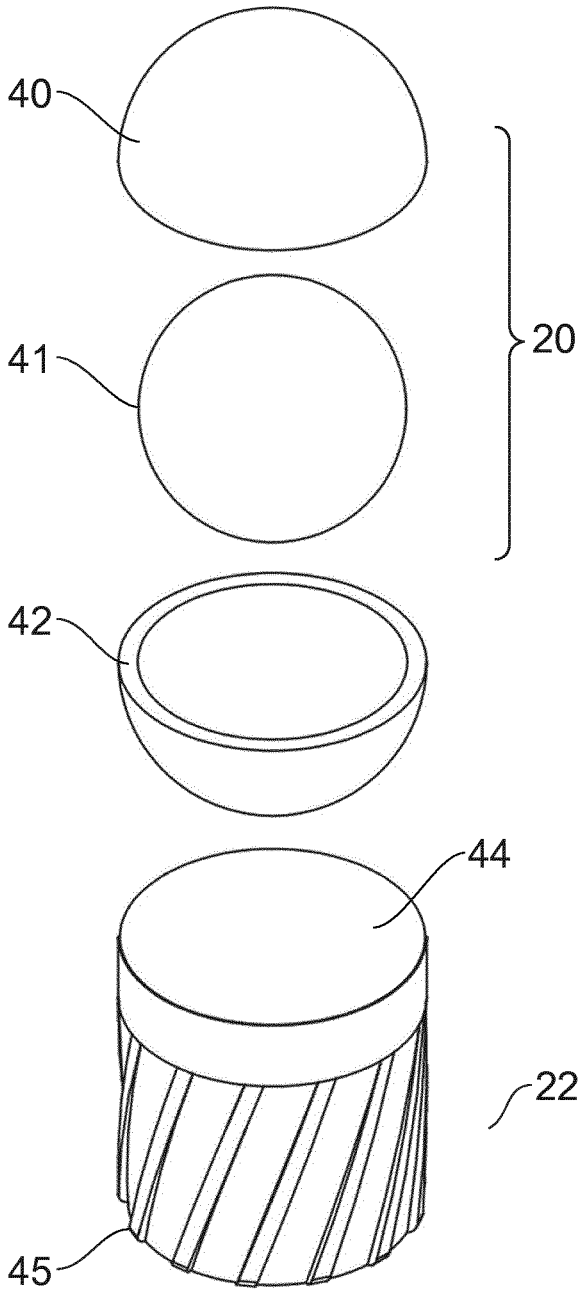
FIG. 6 shows an exploded isometric view of the embodiment shown in FIG. 5.
Figure 7:
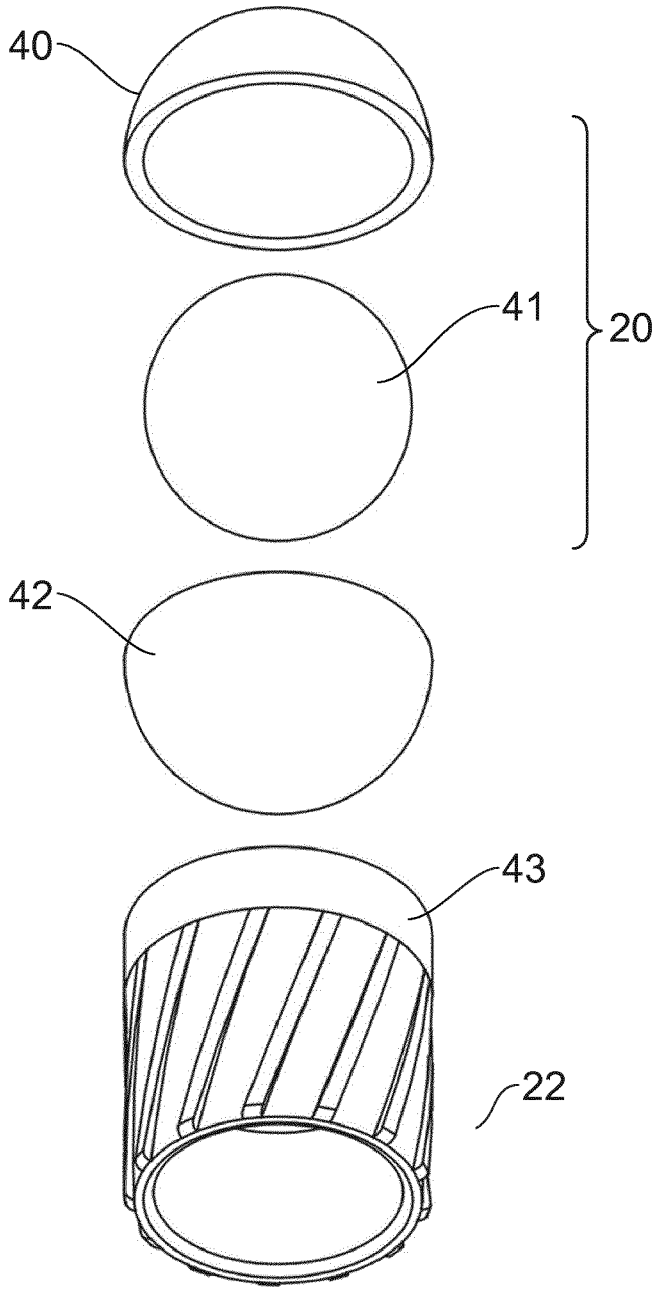
FIG. 7 shows a reverse exploded isometric view of the embodiment shown in FIG. 6.
Figure 8:
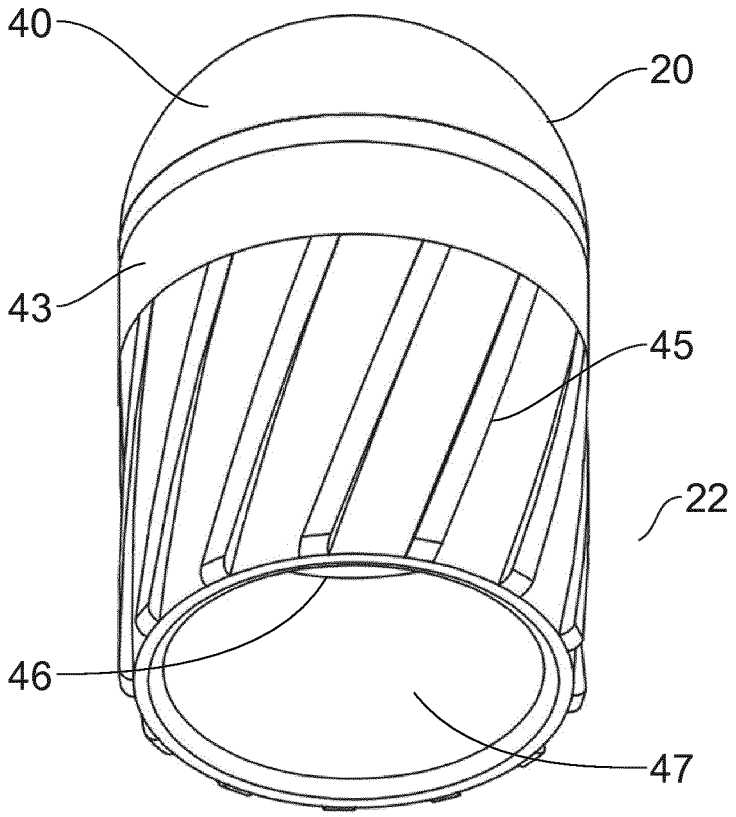
FIG. 8 shows an isometric view of the embodiment shown in FIG. 6.

With reference to FIGS. 1 to 4 there is shown a first embodiment of the device comprising a charge 20 comprising a hemispherical shell 21; and a cylindrical body 22, with rifling 25. The top portion 21 provides a shell covers and contains the marking material 32.

The body has a collar 24 provided at the distal end and centrally located opening 37 at the proximal end of the body. The opening 37 is for receiving a projection.

The body is comprised from a lightweight foam core 29, which is solid and is shaped to have concave distal end to enhance flight accuracy and so as to reduce weight.

The distal end of the body has an inclined indentation 28 leading to a convex centre 26 so as to advantageously provide enhanced strength to the body under crushing, aiding reuse.

The marking material 32 is positioned on a base 33. The base 33 has a projection 35 that extends downwards away from the marking material 32. The projection 35 is adapted to be received by a corresponding opening 36 provided on a planar tray 30.

The projection 35 fits into the opening 36 so as to connect the parts. The top portion 21, the marking material 32 and the base 33 are mounted on a planar tray 30. The planar tray 30 has a circular lip 23 that extends upwards around the circumferential edge of the planar tray 30.

The base 33 connects to the planar tray 30 by an interference fitting. The planar tray 30 receives the charge, the shell and the base, and is adapted to be connected to the body 22 by means of a spike 38 inserted in to the opening 37 to form and interface fit.

A lower face of the planar tray 30, that interfaces the body when assembled, has a spike 38 which is adapted to be received by the body 22 in order to connect the charge 20, by means of the planar tray 30 to the corresponding second opening 37 that is provided on the body 22.

The parts are assembled to form the ammunition device or pellet.

The planar base 30 connects to the opening 37 in the body by an interference fitting.

In this way the parts can be push fitted together. This allows the pellets to be easily manually assembled.

Some, or all of, the parts may be fastened or connected in such a way that they cannot be easily disconnected, or that they only disconnect upon impact after firing. This prevents assembled pellets separating before use.

Some or all of the parts may have a temporary lock mechanism, such as a ball and socket arrangement or detent mechanism that provide a reliable connection that disconnects at a predetermined force.

It is appreciated that in some embodiments the parts may be bonded together by an adhesive, heat process or pressure. For example an adhesive may be used to adhere parts together. The base 33 may be adhered to the planar tray 30. The adhesive may be in addition to a temporary lock mechanism.

With reference to FIGS. 5 to 8 there is shown a second embodiment of the device comprising for containing a spherical marking material.

In the second embodiment the charge comprises a first hemispherical shell 40 and a second hemispherical shell 42. The first shell 40 and the second shell 42 form a spherical container shell that covers and contains the marking material 41.

The body is substantially cylindrical with a central hemispherical concave indentation 44 for receiving the charge. The concave indentation 44 is shaped to correspond with the size of the charge so that the shells 40, 42 fit within the indentation 44.

The charge can be rotated within the indentation 44 so as to be arranged in the preferred arrangement. For example, the first shell may be thinner so as to more easily break on impact.

Preferably the lower portion 42 is arranged to sit within the indentation 44 so that the shell 40 is exposed to contact with a target when fired.

The body 22 comprises a top collar 43. The collar has a smooth outer finish to help reduce friction and drag when travelling down the barrel of the firearm.

The outer face of the body is rifled 45 to assist with flight of the pellet. The rifling deepens towards the distal end of the body 22.

The distal end of the body further comprises a deep indentation 47 and planar indent 46. This shaping defines a 'Kamm Tail' so as to advantageously aid flight characteristics. The distal end of the body has a Kamm Tail which reduces drag when travelling through the air.

In the second embodiment the body is weighted. The weighted rubber body improves the pellet's range and accuracy.

In the first and second embodiments the charge has a thin moulded outer shell and inner core of inert liquid or powder paint. This behaves in a similar way to standard paintballs on impact.

The body is made from a reaction injection moulding process to allow for a lightweight foam core with a thin film around the outside and the marking material is encased within a Polystyrene shell.

Figure 10:
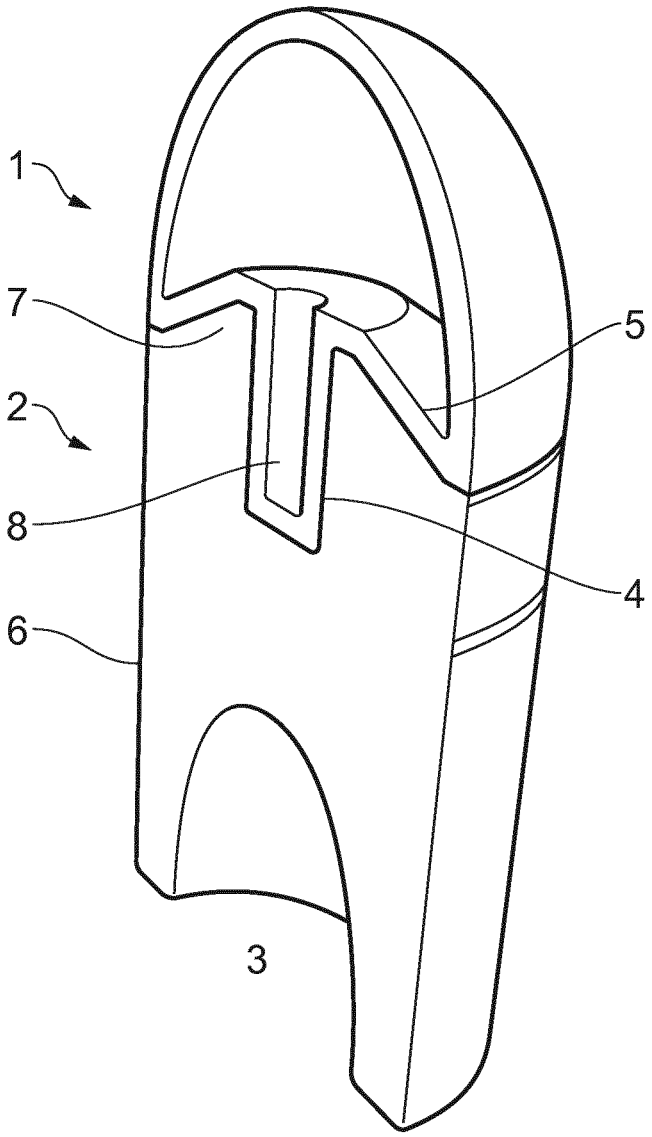
FIG. 10 shows a sketch of an isometric sectional view of a third embodiment of the ammunition device according to the present invention.
Figure 11A:
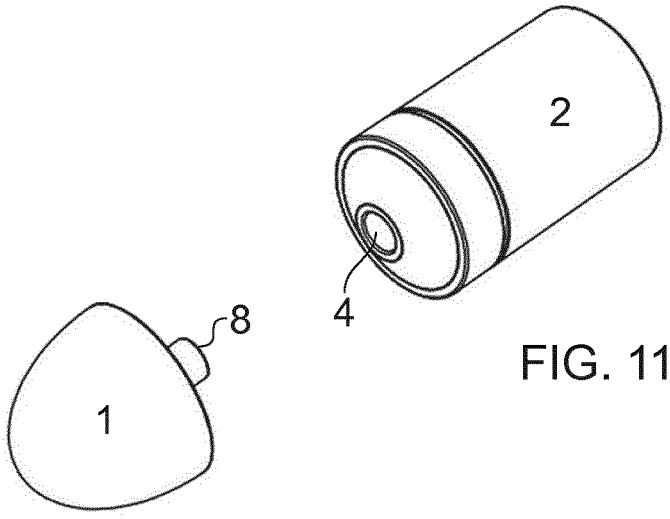
Figure 11B:
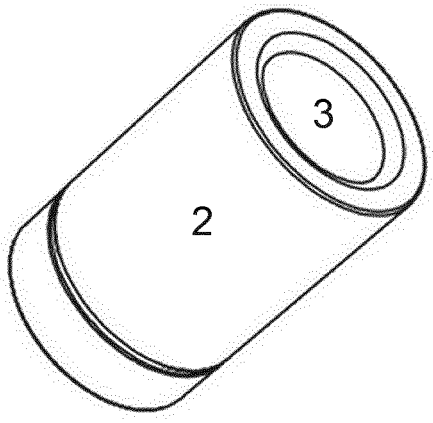
Figure 11C:
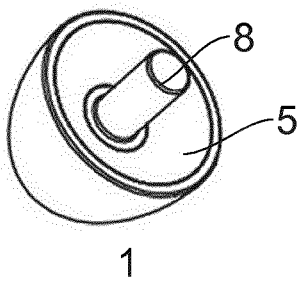
Figure 11C:
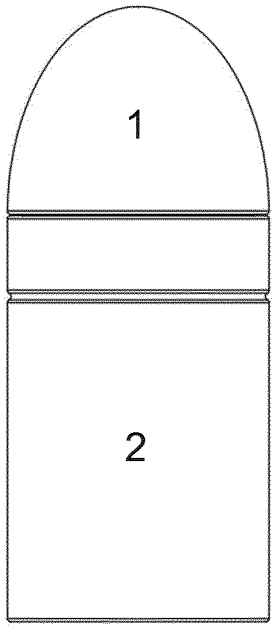
Figure 12A:
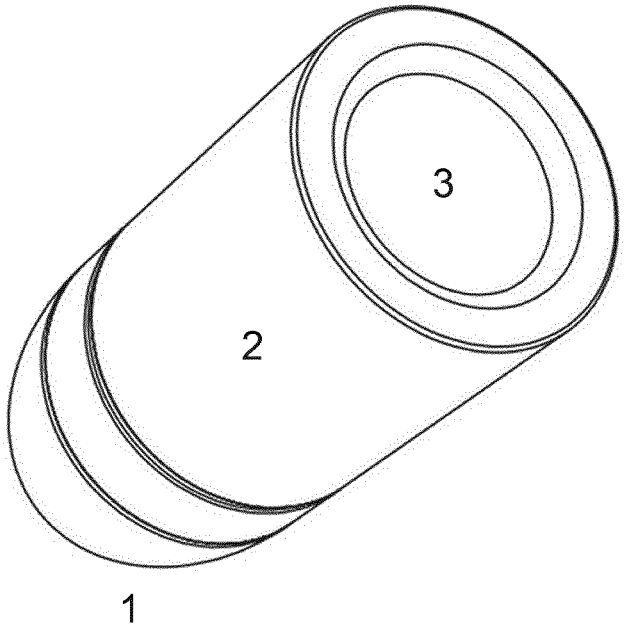
FIGS. 12A, 12B and 12C show isometric an end views of the embodiment shown in FIGS. 11A, 11B and 11Cb.
Figure 12B:
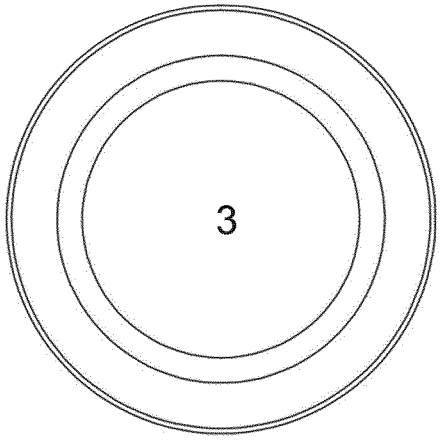
Figure 12C:
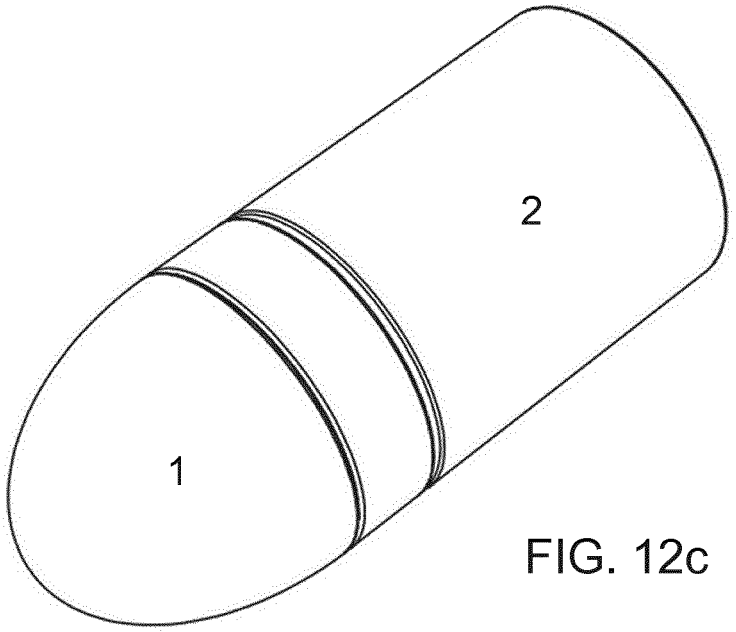

With reference to FIGS. 10 to 12 the third embodiment of the first aspect of the present invention comprises a body 2 having a recess 3 at the rear end.

The body 2 is adapted to receive a replaceable charge 1.

The body 2 comprises a smooth outer wall 6. The body 2 has a circular axial cross-section with a solid convex proximal end that receives the charge 1.

The proximal end comprises a central opening 4 for receipt of a corresponding pin 8 provided on the charge 1.

The lower face of the charge 1 is shaped to correspond to the shape of the body 2. The lower face of the charge 7 is concave or has an inclined extending face to allow the upper convex face 5 of the body 2 to indent into the charge 1 and improve connection therebetween.

The pin 8 is inserted into the opening 4 of the body to create an interference fit between the device parts so as to provide a unified unit.

The body is dense rubber formed by a high volume moulding process from materials such as HDPE (High Density Polyethene). Such dense rubber bodies are intended for repetitive use and therefore suitable for a reusable version of the ammunition device.

In the third embodiment, shown in FIG. 10, the charge 1 is formed by pressure treating a volume of powder using a die mould. This process produces a charge in the desired form with a solidified thin outer skin and a powder state inner wherein the charge thereby comprises a solidified powder paint thin outer skin or shell with a loose powder paint inside.

The charge may be manufactured by a method comprising the steps of: treating a volume of powder, using a die mould to produce a charge with a solidified thin outer skin and a powder state inner.

When the pellet or ammunition device is fired the charge breaks on impact releasing the marking material. When the ammunition device or pellet hits a target the marking material is released by the force of impact which breaks the shell so as to release the marking material. The disbursing marking material creates a visible mark. For example the marking material may create a red cloud which is to simulate a blood splatter, spray, and mist.

For devices with a reusable body, the bodies can be collected after use and the round can be recharged by applying a new charge to the existing body.

In all preferred embodiments the forward facing portion of the charge is curved providing an aerodynamic nose to the device.

Figure 9:
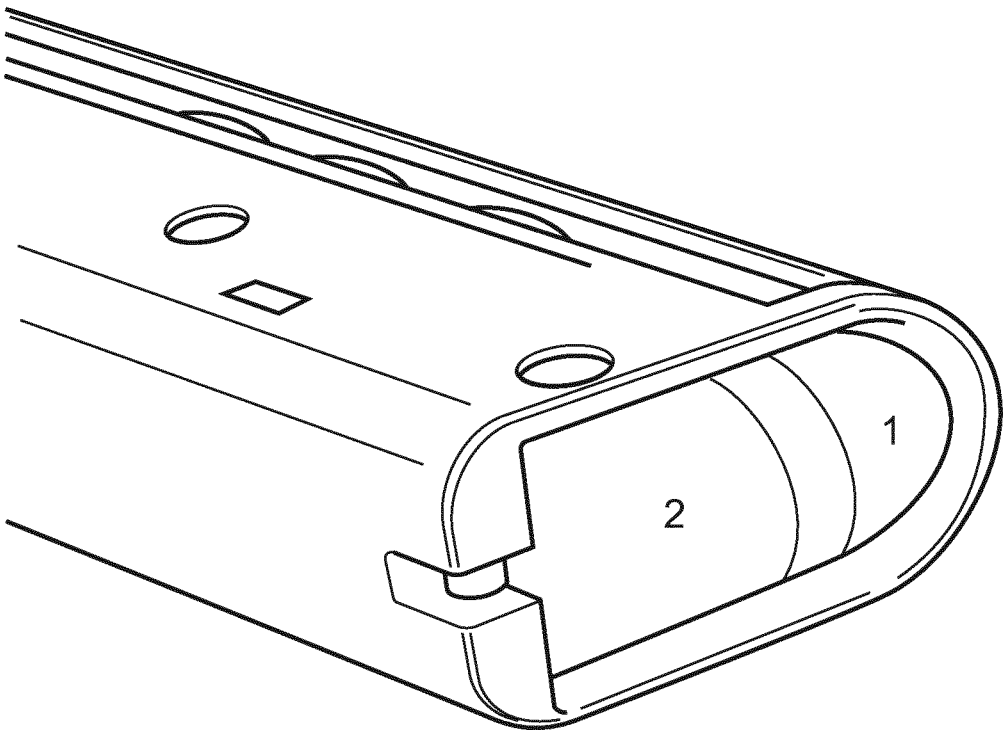
FIG. 9 shows a sketch of an isometric view of a detail of a cartridge of ammunition devices according to the present invention.

The ammunition device or pellet works specifically with a range of battery powered firearms, using a box magazine such as shown in FIG. 9 or rotary magazine to load the pellets depending on the style of firearm. Reloading and loading is quicker and easier. The range of firearms use standard technology from traditional battery powered firearms, but does not suffer known problems with standard ammunition.

The invention has been described by way of examples only and it will be appreciated that variation may be made to the above-mentioned embodiments without departing from the scope of invention as defined by the claims.

The invention claimed is:

1. An ammunition device comprising:

an aerodynamic body; and a charge securely connected to a forward end of the aerodynamic body, the charge being configured to break upon impact; wherein the aerodynamic body comprises an aerodynamic form that is adapted to secure connection to the charge at an axial central connector, the charge is a single-use portion arranged in use to be attachable to the aerodynamic form, and the charge comprises a breakable outer shell for surrounding marking material.

2. The ammunition device according to claim 1 wherein the charge comprises a base portion to receive a marking portion of the charge.

3. The ammunition device according to claim 2 wherein the base portion has an axial central projection that is received by a corresponding axial central opening provided on the aerodynamic body in order to axially connect the base portion and thereby the charge to the aerodynamic body.

4. The ammunition device according to claim 1 wherein the charge comprises connected plural outer shell parts.

5. An ammunition device comprising:

an aerodynamic body; and a charge securely connected to a forward end of the aerodynamic body, the charge being configured to break upon impact; wherein the aerodynamic body comprises an aerodynamic form, the form and the charge being formed as a single unit with secure connection between the charge and the aerodynamic body at an axial central connector, the charge is a single-use portion arranged adjacent the aerodynamic form, and the charge comprises a breakable outer shell for surrounding marking material.

6. The ammunition device according to claim 5 wherein the aerodynamic body is formed from cellular structure material.

7. The ammunition device according to claim 6 wherein the cellular structure material is foam.

8. The ammunition device according to claim 6 wherein the cellular structure material is rubber.

9. The ammunition device according to claim 5 wherein the aerodynamic form is an elongate form with a first convex end.

10. The ammunition device according to claim 9 wherein the charge has a concave rearmost portion for receiving the first convex end of the elongate form.

11. The ammunition device according to claim 5 wherein the aerodynamic body has a rifled outer surface.

12. The ammunition device according to claim 5 wherein a rearmost end of the aerodynamic body comprises a central indentation towards the charge in use.

13. The ammunition device according to claim 5 wherein the charge has a curved outer face.

14. A method of manufacturing an ammunition device according to claim 5 wherein the charge and the aerodynamic body are sequentially injected into a mould to form the single unit.

15. A method of manufacturing an ammunition device according to claim 5 having the steps:

using a mould to create a skin; and arranging the charge and the aerodynamic body within the skin.

16. The ammunition device according to claim 1, wherein:

the aerodynamic body is reusable.

17. The ammunition device according to claim 1, wherein:

the aerodynamic body is biodegradable.

18. The ammunition device according to claim 17, wherein:

the charge is biodegradable.

19. The ammunition device according to claim 1, wherein:

the charge is biodegradable.

* * * * *